United States Patent [19]

Schuessler et al.

[11] 4,092,620

[45] May 30, 1978

[54] ELECTRICAL CONNECTION FOR THE MOVING CONTACTS OF A RELAY

[75] Inventors: John C. Schuessler, West Covina; David J. Tapp, Manhattan Beach, both of Calif.

[73] Assignee: Leach Corporation, Los Angeles, Calif.

[21] Appl. No.: 669,213

[22] Filed: Mar. 22, 1976

[51] Int. Cl.[2] ..... H01H 67/02

[52] U.S. Cl. ..... 335/128; 200/244; 200/251

[58] Field of Search ..... 335/128; 200/237, 239, 200/242, 244, 245, 251, 280, 281, 290, 291, 287, 283

[56] References Cited

U.S. PATENT DOCUMENTS

| | | | |
|---|---|---|---|
| 750,040 | 1/1904 | Varley | 200/251 X |
| 3,114,808 | 12/1963 | Van Zyl | 200/251 X |

*Primary Examiner*—George Harris

*Attorney, Agent, or Firm*—Christie, Parker & Hale

[57] ABSTRACT

An electrical connection for the moving contacts of a relay in which a connector pin in the header of the relay and the moving contacts are electrically connected by a cantilever spring contact supported on the connector pin, the cantilevered spring contacts extending substantially parallel to the contact blade of the relay. The free end of the spring has a curved projecting portion which presses lightly against the surface of the contact blade adjacent the pivotal axis of the blade, allowing the contact blade to pivot freely while maintaining electrical contact between the spring and blade.

1 Claim, 1 Drawing Figure

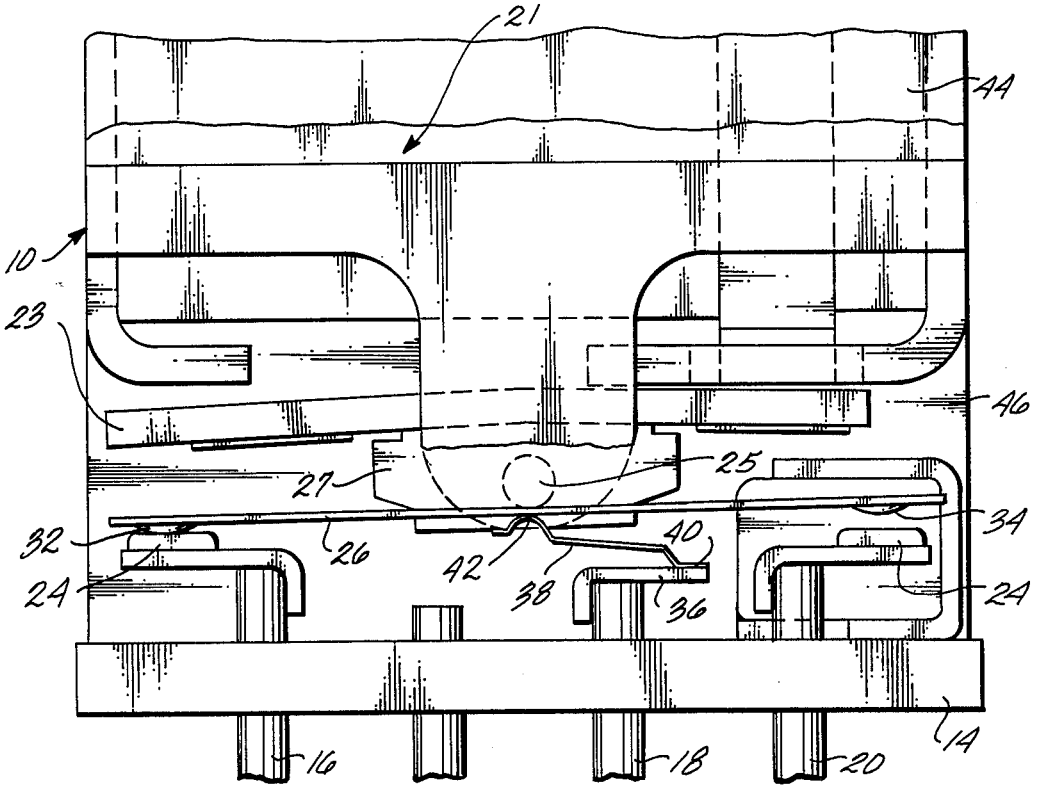
21
44
10
23
46
27
25
34
32
26
40
42
38
36
24
24
14
16
18
20

ELECTRICAL CONNECTION FOR THE MOVING CONTACTS OF A RELAY

FIELD OF THE INVENTION

This invention relates to electrical relays, and more particularly is concerned with high performance electromechanically operated relays of compact design.

BACKGROUND OF THE INVENTION

High performance relays are utilized in great numbers in the aircraft, aerospace, and electronics industries in which a premium is placed on minimum weight and physical size for operation under extreme environmental conditions and with high electrical capacities. Relays capable of switching currents of 10 amperes or more at switching times of less than a millisecond and occupying a total volume of less than seven cubic centimeters make the design and manufacture of the relay parts extremely critical and expensive. In attempting to scale down the size of component parts to reduce the weight and size of the relay, careful attention must be given to strengths of materials in order to withstand shocks of up to 200 g's, vibrations of up to 50 g's, and at the same time the relay must provide minimum contact resistance, as well as sufficient insulation and spacing to prevent voltage breakdown and arcing.

Such high performance relays are constructed so that the entire relay assembly, including the relay motor and the switches operated by the relay motor, are hermetically sealed. All the electrical connections to the switch contacts as well as to the electromagnetic motor are made through a group of connector pins which pass through a header, the pins being mounted in the header by glass or ceramic seals.

One arrangement for providing electrical connection between a contact pin and the moving switch contacts of the relay is shown in U.S. Pat. No. 3,484,729. This patent discloses an arrangement in which a bracket welded to the end of the contact pin extends parallel to a pivotally supported blade to which the moving contacts are attached. A flat spring formed in a compressed U-shape is positioned between the bracket and the blade, the ends of the U-shaped spring being bent outwardly to pivotally engage respectively the bracket and the center of the blade. The spring action holds the U-shaped contact spring in place with a minimum of load restricting the motion of the blade by the relay.

While the U-shaped spring as a separate part provides a satisfactory electrical connection, and retains itself in place by compression with a minimum of mechanical movement and drag, because it is a separate part it must be inserted after the relay is assembled. This is not only time consuming but takes considerable dexterity in the very tight spaces of a multipole relay.

SUMMARY OF THE INVENTION

The present invention provides an improved electrical connection for the moving contacts of a relay which simplifies the assembly operation. Specifically, the present invention provides an electrical connection between a contact pin in the header of a relay and the pivoting blades supporting the moving contacts of the relay switch. The electrical connection is in the form of a cantilever spring contact having one end attached permanently to a contact pin by a supporting bracket, the cantilevered spring extending substantially parallel to the blade supporting the moving contacts of the switch.

The free end of the cantilever spring is formed with a curved projecting portion which is urged by the spring against the surface of the contact blade adjacent the pivotal axis of the blade.

DESCRIPTION OF THE DRAWINGS

For a better understanding of the invention reference should be made to the accompanying drawing, wherein:

The single FIGURE is a partial side elevational view of a relay incorporating the present invention.

DETAILED DESCRIPTION

Referring to the drawing in detail, the numeral 10 indicates a relay assembly of the type, including a base or header 14 through which extends a plurality of contact pins 16, 18 and 20. The pins pass through the header and are hermetically sealed to the header by glass seals (not shown). The pins project into the interior of the relay with the outermost pins 16 and 20 providing direct support for the fixed switch contacts 24 of the relay.

A relay motor assembly 21 includes an armature 23 which is pivotally supported for rotation about an axis 25. A moving contact blade 26 is mounted on the armature by means of an insulating block 26. Opposite ends of the blade 26 terminate in moving switch contacts 32 and 34. Rotation of the armature assembly by the relay opens and closes the respective sets of contacts.

To provide an electrical connection between the moving contact blade 26 and the center contact pin 18, an L-shaped bracket 36 is secured to the inner end of the pin 18. One leg of the bracket 36 is welded or otherwise secured to the side of the pin 18 while the other leg of the bracket extends substantially parallel to the header 14 and the contact blade 26. A cantilevered spring finger 38 is spot-welded or otherwise attached to the outer end of the bracket 36, as indicated at 40, the end 40 being offset from the rest of the spring finger 38 to provide ample spacing between the bracket and the spring finger. The outer end of the cantilever supported spring finger is formed with a curved projection 42.

The relay is assembled by mounting the motor assembly 21 to the header by means of side frame plates 44 and 46. When the motor assembly is in position relative to the header, the projecting portion 42 of the spring finger 38 is held against the surface of the moving contact blade 26 at a position aligned with the axis of rotation 25 of the armature assembly. The cantilevered spring finger 38 is bent down slightly by contact with the blade 26 toward the header 14 so that pressure is maintained between the projection 42 and the contact blade 26 when the relay motor assembly 21 is secured in position. The cantilever spring finger 38 is made of a highly conductive material such as a silver magnesium alloy. Thus the spring finger can be pre-assembled with the header, and when the relay motor is attached to the header, an electrical circuit is completed from the contact blade 26 to a contact pin 18 through the spring finger 38. Rotation of the armature produces a sliding action between the projection 42 and the blade. This produces a self-cleaning action, resulting in lower contact resistance.

What is claimed is:

1. In a relay having moving contacts supported on a pivoted contact blade actuated by the relay, apparatus for completing an electrical circuit to the contact blade, comprising a header having at least one connector pin extending therethrough, and means including a cantilever spring contact attached at one end to the contact pin and supported thereby, the cantilevered spring contact extending substantially parallel to the contact blade, the free end of the spring having a curved projecting portion pressing against the surface of the contact blade, the curved projecting portion engaging the contact blade adjacent the pivot axis of the contact blade.

* * * * *